US005705323A

United States Patent [19]

Perry et al.

[11] Patent Number: 5,705,323

[45] Date of Patent: Jan. 6, 1998

[54] HEAT BLEACHABLE ANTIHALATION COMPOSITION, ELEMENTS CONTAINING SAME AND METHOD OF USE

[75] Inventors: Robert James Perry, Pittsford; Ramanuj Goswami, Webster; Paul Anthony Zielinski, Rochester, all of N.Y.

[73] Assignee: Eastman Kodak Company, Rochester, N.Y.

[21] Appl. No.: 583,395

[22] Filed: Jan. 5, 1996

[51] Int. Cl.[6] ..... G03C 1/498

[52] U.S. Cl. ..... 430/350; 430/510; 430/517; 430/617; 430/619

[58] Field of Search ..... 430/617, 350, 430/517, 339, 341, 343, 332, 614, 510

[56] References Cited

U.S. PATENT DOCUMENTS

| | | | |
|---|---|---|---|
| 3,383,212 | 5/1968 | MacLachlan | 96/48 |
| 3,390,994 | 7/1968 | Cescon | 96/48 |
| 3,445,234 | 5/1969 | Cescon et al. | 96/90 |
| 3,533,797 | 10/1970 | James et al. | 96/90 |
| 3,615,481 | 10/1971 | Looney | 96/48 |
| 3,630,736 | 12/1971 | Cescon | 96/48 |
| 3,666,466 | 5/1972 | Strilko | 96/48 |
| 3,734,733 | 5/1973 | Poot et al. | 96/48 |
| 4,196,002 | 4/1980 | Levinson et al. | 430/617 |
| 4,201,590 | 5/1980 | Levinson et al. | 430/617 |
| 5,258,274 | 11/1993 | Helland et al. | 430/522 |

*Primary Examiner*—Thorl Chea

*Attorney, Agent, or Firm*—J. Lanny Tucker

[57] ABSTRACT

Heat bleachable antihalation compositions are prepared using metallized or unmetallized formazan dyes, hexaarylbiimidzoles having alkoxy substituents and organic carboxylic acids. These compositions are rapidly bleached at relatively low temperatures and can be used in photothermographic elements.

24 Claims, No Drawings

HEAT BLEACHABLE ANTIHALATION COMPOSITION, ELEMENTS CONTAINING SAME AND METHOD OF USE

FIELD OF THE INVENTION

This invention relates to colored, heat bleachable compositions that undergo a change in electromagnetic absorption characteristics upon application of heat. These compositions are useful as antihalation components of photothermographic elements. This invention also relates to forming thermographic images using these compositions and elements.

BACKGROUND OF THE INVENTION

A variety of photographic materials are known that can be processed by immersion in various processing solutions or baths. Such materials contain various layers and components, including antihalation or filter layers, overcoats and radiation sensitive layers.

The antihalation layer of an imaging element helps to prevent light that has passed through the radiation sensitive layer(s) from reflecting back into those layers. If reflection is not prevented, the resulting image is less sharp. In wet processes, the antihalation layer is generally removed or rendered colorless during processing.

Imaging elements are also known that can be processed, after imagewise exposure, simply by heating the element. These elements are often known as thermographic or photothermographic elements. It is generally desired that such elements include an antihalation or filter layer, especially to provide improved microimaging capability. In most cases, the antihalation layer must be rendered substantially transparent upon heat processing in order to avoid use of processing solutions.

A variety of antihalation compositions have been reported in the literature whereby the use of processing solutions is avoided. Such compositions generally include particular heat bleachable antihalation dyes, or incorporated addenda that act as bleaching agents.

For example, the use of radicals from biimidazoles in antihalation compositions is known, being described for example in U.S. Pat. No. 4,196,002 (Levinson et al) and U.S. Pat. No. 4,201,590 (Levinson et al). The heat developable compositions described therein become colorless upon exposure to heat for a given time. The compositions contain formazan dyes used in reactive association with certain hexaarylbiimidazole compounds, which compounds are primarily oxidative dimers of alkyl-substituted-arylimidazoles.

All of the known antihalation compositions suffer from one or more problems, including heat instability and requiring high heat processing or only temporary bleaching. There is a continuing need for antihalation compositions that can be permanently and quickly bleached at lower temperatures.

SUMMARY OF THE INVENTION

The present invention overcomes the problems noted above with a colored, heat bleachable antihalation composition comprising:

(a) a formazan dye that absorbs at from about 400 to about 850 nm, and (b) at least one hexaarylbiimidazole that consists essentially of an oxidative arylimidazole dimer of a compound represented by either structure Ia or Ib:

Ia

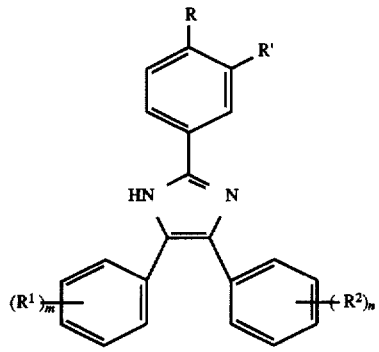

Ib

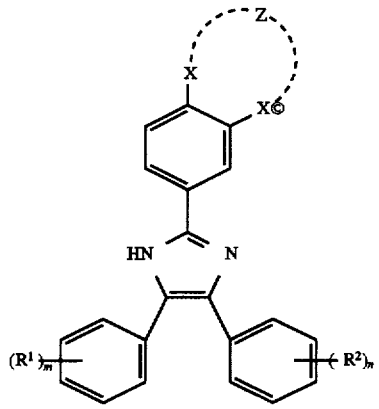

wherein R and R' are independently hydrogen, an alkyl group of 1 to 12 carbon atoms, an alkoxy group of 1 to 12 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is the alkoxy or amino group, X and X' are independently oxy or imino, and Z is alkylene of 1 or 2 carbon atoms, and $R^1$ and $R^2$ are independently defined the same as R and R' except that neither $R^1$ nor $R^2$ is hydrogen, and the antihalation composition being bleachable when subjected to a temperature of from about 80° to about 150° C. for from about 1 to about 60 seconds.

This invention also provides a photothermographic element comprising a support having thereon a photothermographic layer, and further comprising, on or in the support, the antihalation composition described above.

Still further, this invention provides a method for providing an image comprising subjecting an imagewise exposed photothermographic element as described above, to heat at from about 80° to about 150° C. for from about 1 to about 60 seconds.

DETAILED DESCRIPTION OF THE INVENTION

A critical component of the antihalation composition of this invention is at least one (one or more) hexaarylbiimidazole that consists essentially of an oxidative arylimidazole dimer of the compound represented by either structure Ia or Ib:

Ia

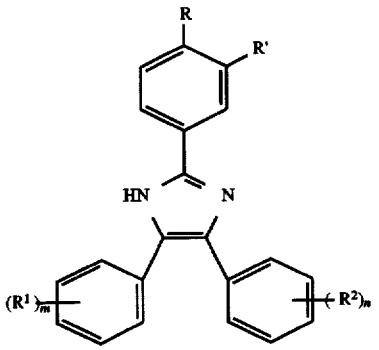

Ib

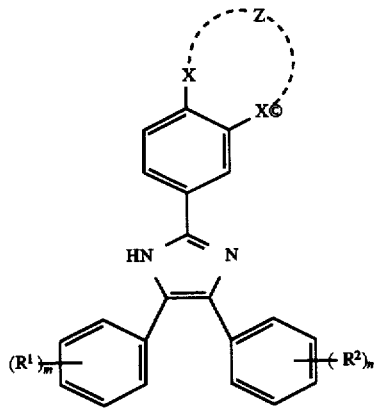

wherein R and R' are independently hydrogen, a substituted or unsubstituted alkyl group of 1 to 12 carbon atoms (such as substituted or unsubstituted methyl, ethyl, n-propyl, isopropyl, i-butyl, t-butyl, hexyl, dodecyl, benzyl or neopentyl), a substituted or unsubstituted alkoxy group of 1 to 12 carbon atoms (such as substituted or unsubstituted methoxy, ethoxy, 1-propoxy, benzyloxy, ethyleneoxy or dodoxy), amino (primary, secondary or tertiary having one or more alkyl groups as defined above), a substituted or unsubstituted cycloalkyl having 5 to 7 carbon atoms in the ring (such as substituted or unsubstituted cyclopentyl, cyclohexyl or cycloheptyl), or an electron-rich substituted or unsubstituted heterocyclic group having 5 to 7 atoms (carbon, oxygen, sulfur and nitrogen) in the central ring (such as substituted or unsubstituted furanyl, thiophenyl, pyridyl or pyrrolyl). Other heterocyclic rings would be readily apparent to a skilled artisan.

$R^1$ and $R^2$ are independently defined the same as for R and R' except that neither $R^1$ nor $R^2$ is hydrogen. Preferably, $R^1$ and $R^2$ are independently a substituted or unsubstituted alkyl group of 1 to 4 carbon atoms or a substituted or unsubstituted alkoxy group of 1 to 4 carbon atoms.

When the compounds have an $R^1$ or $R^2$ substituent, it can be at any position on the respective phenyl rings. Preferably, the one or more $R^1$ or $R^2$ groups are in the ortho or para positions of the phenyl rings, in relation to the carbon atoms attached to the imidazole ring. Preferably, when one of $R^1$ or $R^2$ is present, it is in the para or 4-position.

In structure Ia, it is essential that at least one of R and R' is an alkoxy group or amino group as defined above. Preferably, at least one is an alkoxy group (substituted or unsubstituted) of 1 to 8 carbon atoms, and more preferably, R is an alkoxy group (substituted or unsubstituted) of 1 to 6 carbon atoms. Most preferably, R is an alkoxy group (substituted or unsubstituted) of 1 to 4 carbon atoms.

In structure Ib, X and X' are independently oxy or imino (—NR"—). Thus, each or both of X and X' can be the same or different divalent group. Preferably, at least one of them is oxy, and more preferably, each of X and X' is oxy. Z is alkylene of 1 or 2 carbon atoms, and can be substituted. Preferably, Z is methylene. R" can be hydrogen or a substituted or unsubstituted alkyl group of 1 to 12 carbon atoms (as defined above for R), or a substituted or unsubstituted aryl group of 6 to 10 carbon atoms in the ring (such as phenyl, naphthyl, xylyl, p-methoxyphenyl or p-chlorophenyl). Preferably, R" is hydrogen, methyl or ethyl, and more preferably, it is hydrogen.

Moreover, in structures Ia and Ib, m and n are independently integers of 0 to 5, and preferably, m and n are each 0 or 1. Most preferably, each of m and n is 0.

A particularly useful hexaarylbiimidazole is:

R-1

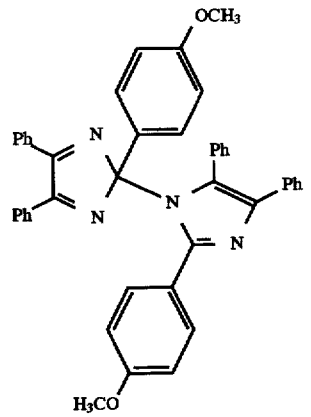

wherein "Ph" is phenyl.

Other useful hexaarylbiimidazoles are described in U.S. Pat. Nos. 3,383,212 (MacLachlan), 3,390,994 (Cescon), 3,445,234 (Cescon et al), 3,533,797 (James et al), 3,615,481 (Looney), 3,630,736 (Cescon et al), 3,666,466 (Strilko et al) and 3,734,733 (Poot et al), as long as they fall within either of structures Ia and Ib. Other useful compounds are described in Examples 16–26 below.

If desired, a combination of hexaarylbiimidazoles of the noted structure can be used. These materials can be readily prepared using known preparatory methods, described for example in the noted Levinson et al patents and the other references cited above. For example, one preparation is described by Hayashi, *Bull. Chem. Soc. Japan*, 33, 565 (1960).

Important teaching relating to hexaarylbiimidazoles has been published by Aldag, *Photochromism, Molecules and Systems*, Durr and Bouras-Laurent (Eds.), Chapter 18, pages 714–717, Elsevier, 1990. A single triarylimidazole can conceivably give rise to different structural dimers in the dimer linkage is made via C—N, C—C or N—N bonds. These individual structural dimers or mixtures thereof can be generated chemically, thermally or photolytically from a common triarylimidazoyl radical. While the dimers specifically described herein are linked via a C—N bond (2-carbon atom of one imidazole ring and nitrogen atom of the other imidazole ring), the present invention is not so limited.

The formazan dye complexes useful in the present invention absorb at from about 400 to about 850 nm. Preferably, formazan dyes absorbing at from about 500 to about 850 nm are used. Useful formazan dyes are well known in the art, including the Levinson et al patents cited above, both of which are incorporated herein by reference. The formazan dyes can be metallized or unmetallized.

More particularly, useful formazan dyes can be represented by structure II:

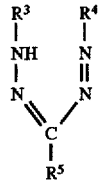

wherein $R^3$ is a substituted or unsubstituted aromatic group of 6 to 20 atoms in the ring system, such as a carbocyclic or heterocyclic aromatic ring. Preferably, $R^3$ is a substituted or unsubstituted coordinating aromatic group having 5 to 15 atoms in the ring system when the dyes are used in metallized complexes. Such aromatic groups can be carbocyclic or heterocyclic containing one or more nitrogen, oxygen or sulfur atoms. By "coordinating" is meant that the aromatic group is capable of providing a pair of electrons that can be shared with the metal ion nucleus when the formazan dye and metal are complexed. The aromatic group can be substituted with one or more groups as defined below.

$R^4$ can be an aryl group (substituted or unsubstituted) having from 6 to 14 carbon atoms in the ring system (such as phenyl, tolyl, xylyl, naphthyl, anthryl, p-nitrophenyl, benzthiophenyl, benzimidazoyl or pyridyl).

$R^5$ is an alkyl group (substituted or unsubstituted) of 1 to 20 carbon atoms (such as substituted or unsubstituted methyl, ethyl, n-propyl, isopropyl, t-butyl, hexyl, decyl, benzyl and other branched or linear hydrocarbons readily apparent to one skilled in the art), an aryl group (substituted or unsubstituted) of 6 to 14 carbon atoms in the ring (such as phenyl, xylyl, tolyl, naphthyl, 4-hydroxyphenyl, p-nitrophenyl, dimethoxyphenyl, anthroquinonyl and other substituted carbocyclic aromatic ring systems readily apparent to one skilled in the art), or a substituted or unsubstituted 5- to 7-membered heterocyclic group having 5 to 7 atoms in the ring nucleus, such as pyridyl, pyrimidyl, oxazyl, benzothiazolyl, benzimidazolyl, and others readily apparent to one skilled in the art.

Particularly useful formazan dyes (some in metallized form) include, but are not limited to:

F-1

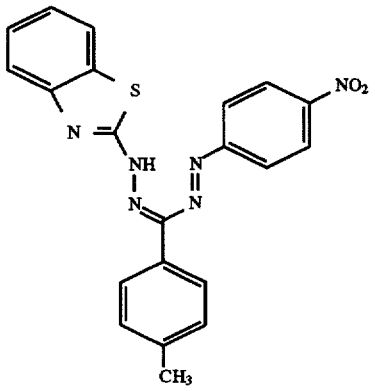

-continued

F-2

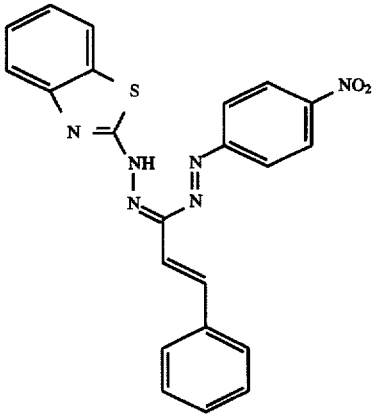

F-3

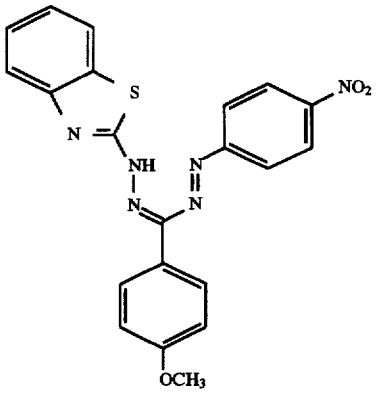

F-4

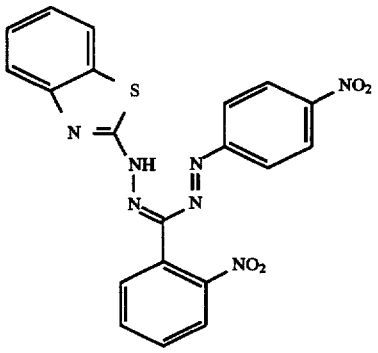

-continued
F-5
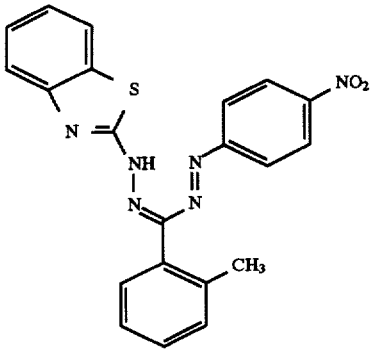
F-6
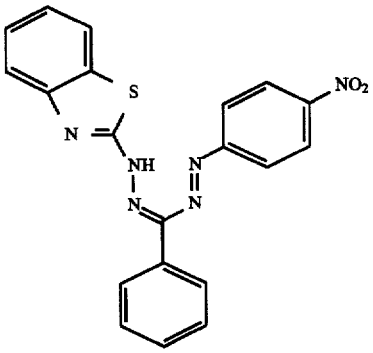
F-7
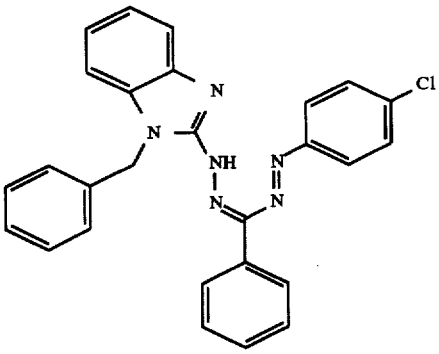
F-8
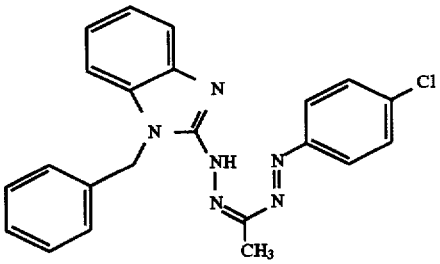
F-9
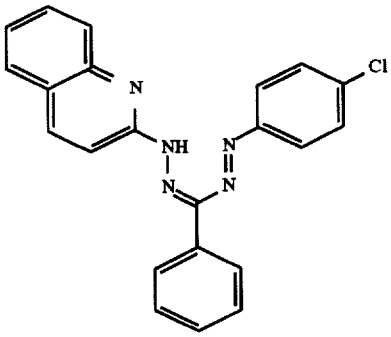
-continued
F-10
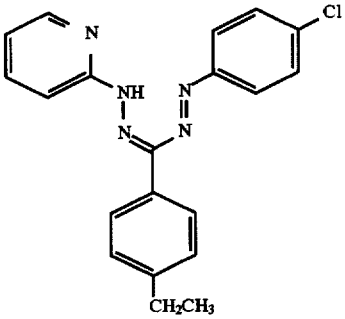
F-11
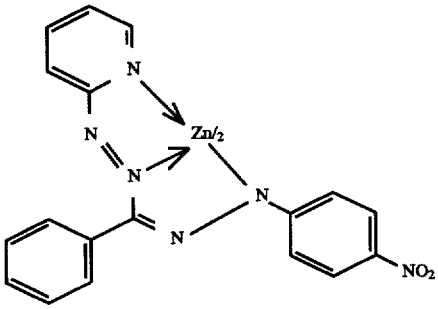
F-12
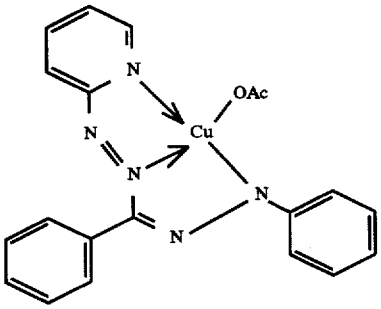
F-13
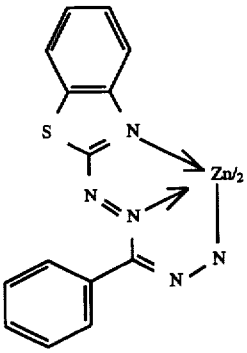
F-14
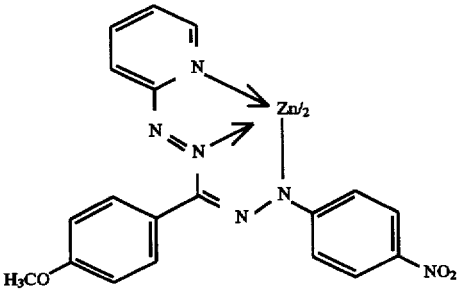

-continued

F-15

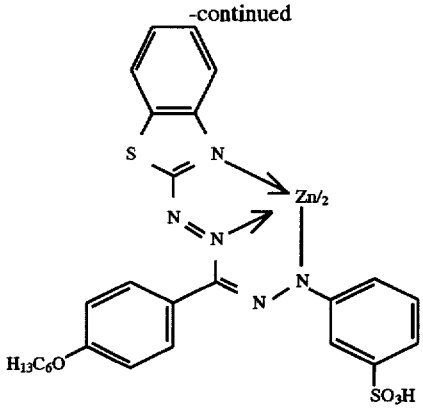

F-16

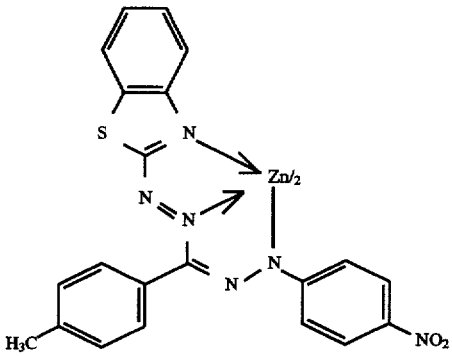

A preferred formazan is F-3 wherein $R^3$ is p-nitrophenyl, $R^4$ is benzthiazole, and $R^5$ is p-methoxyphenyl.

The preparation of formazan dyes is well known in the art, for example as described by Nineham, *Chem. Reviews*, 55, pp. 355–475 (1955).

While the formazan dyes can be used in unmetallized form, preferably, they are used in a metallized complex meaning that they are complexed with one or more suitable metal ions, including but not limited to, cobalt, zinc, cadmium, copper and others readily apparent to one skilled in the art. In general, the metal and formazan dye must be chosen such that the binding constant ($K_b$) with the dye is less than or equal to $10^{25}$. In other words, $\log(K_b)$ must be $\leq 25$. Preferably, $\log(K_b) \leq 21$. Zinc is the preferred metal to use with the formazan dyes listed above, and especially with F-3. Binding constants are described by Uchiumi et al in *Anal. Sci.*, 7, 119–124 (1991).

Methods of making the metallized formazan dyes are well known in the art even if the exact mechanism of complex formation is not fully understood. The metal complexes can be mono- or multidentate. For example, a formazan dye can be mixed with a suitable metal salt (such as an acetate, sulfate or chloride) in a suitable solvent to allow complexation to occur. The resulting metallized complex can be isolated from the reaction mixture and then mixed with the hexaarylbiimidazole as described herein. Alternatively and preferably, the metallized formazan dye complex is formed in situ with the hexaarylbiimidazole, and used directly from the reaction mixture. This embodiment is described below in Examples 16–26. Further details are provided in copending and commonly assigned U.S. Ser. No. 08/698,611 filed on Aug. 16, 1996, and based on Provisional Application filed on even date herewith by Perry, Goswami and Zielinski, and entitled "METHOD OF PREPARING HEAT BLEACHABLE ANTIHALATION COMPOSITIONS AND COMPOSITIONS PREPARED THEREFROM."

A mixture of metallized or unmetallized formazan dyes can be used in this invention if desired, in any suitable proportion. Alternatively, mixtures of unmetallized formazan dyes, or mixtures of metallized formazan dyes, can be used.

When metallized formazan dyes are used, a third critical component of the antihalation compositions of this invention is one or more organic carboxylic acids, each having a pKa of from about 3 to about 6. Preferably, the pKa is from about 4.5 to about 5.5. Useful acids include, but are not limited to, p-propoxybenzoic acid, o-, p- or m-anisic acid, palmitic acid, 2-chlorobenzoic acid, 1-naphthoic acid and 4-propylbenzoic acid. A preferred carboxylic acid is o-anisic acid.

The optimum combination of metallized or unmetallized formazan dye, hexarylbiimidazole compounds, and carboxylic acid will depend upon such factors as the particular antihalation or filter dyes to be used, processing conditions, desired degree of bleaching in the layer containing the metallized formazan dye, solubility characteristics of the components and other factors readily apparent to one skilled in the art. Such optimization would be routine experimentation to a skilled artisan.

The proportions of metallized or unmetallized formazan dye and hexaarylbiimidazole can be readily adjusted over a wide range by a skilled artisan depending upon the location of use in an element, particular filter dyes used, desired degree of absorption, processing temperature and other factors. Thus, in some applications, the concentration of dye is sufficient if it provides an optical density of at least about 0.05, while in other applications, such as in antihalation layers of photothermographic elements, the optical density should be at least about 0.2, with from about 0.3 to about 0.8 being preferred.

The amount of formazan dye used in the compositions is generally from about 1 to about 200 mg/10 g of solution. More preferably, the amount is from about 5 to about 100 mg/10 g solution and more preferably, from about 5 to about 50 mg/10 g of solution. When metallized formazan dyes are used, the amount of metal is generally from about 0.05:1 to about 1:1 molar ratio to formazan dye.

Generally, the molar ratio of hexarylbiimidazole to the formazan dye is from about 1:1 to about 5:1. More preferably, this molar ratio is from about 2:1 to about 3:1.

When metallized formazan dyes are used, the amount of carboxylic acid present in the composition is from about 1:1 to about 20:1 molar ratio with the metal in the metallized formazan dye complex. A molar ratio of from about 2:1 to about 15:1 is preferred.

It is desired that at least 50% (preferably at least 70% and more preferably, at least 90%) of the composition of this invention be bleached (changed from colored to colorless) when subjected to a temperature of from about 80° to about 150° C. for from about 1 to about 60 seconds. Preferably, bleaching occurs at a temperature of from about 100° to about 150° C. for up to about 30 seconds, and more preferably, bleaching occurs at a temperature of from about 110° to about 140° C. for from about 1 to about 15 seconds. It is most desired to completely bleach the composition within about 5 seconds at about 120° C. As one would understand, the lower the bleaching temperature, the longer it takes for the desired bleaching to occur.

An optional but preferred component of the antihalation composition of this invention is one or more film-forming, organic solvent soluble binder materials. Such materials are generally transparent or translucent as films, and do not adversely affect the reaction occurring during bleaching of the metallized or unmetallized formazan dye. Moreover, the binder materials must be able to withstand the conditions of heating necessary for bleaching and be compatible with the formazan dye and hexaarylbiimidazoles. By compatible is meant that the binder material must not adversely affect these components or the desired heat bleachability. These materials are soluble in one or more organic solvents including but not limited to, lower alcohols (such as methanol, ethanol, isopropanol and isobutanol), ketones (such as acetone, methyl ethyl ketone, methyl isobutylketone and ethyl acetate), chlorinated solvents (such as methylene chloride, trichloromethane and tetrachloroethylene), N,N-dimethylformamide, tetrahydrofuran, dimethyl sulfoxide, toluene, acetonitrile and mixtures of any of these. While the useful binder materials may not be soluble in every organic solvent, each one is soluble in at least one of such solvents. Acetone, and a mixture of acetone and methyl isobutyl ketone are preferred. The mixture is most preferred.

Particularly useful binder materials include, but are not limited to, polystyrene (as well as polymers of derivatives of styrene), polyacrylates and polymethacrylates [such as poly (methyl methacrylate), poly(butyl methacrylate) poly(2-hydroxyethyl)methacrylate, poly(ethyl methacrylate) and poly(hexyl methacrylate)], polycarbonates, cellulose esters (such as cellulose acetate butyrate, cellulose acetate propionate, carboxylated cellulose and copolymers thereof), polysulfonamides [such as poly(ethylene-co-1,4-cyclohexylenedimethylene-1-methyl-2,4-benzene disulfonamide)], polyacetals [such as poly(vinyl butyral), and poly(vinyl formal)], polymers of vinyl or vinylidene halides [such as poly(vinylidene chloride) and poly(vinyl chloride)], polyvinyl acetate, maleic anhydride ester copolymers, butadiene-styrene copolymers, acrylonitrile-vinylidene chloride copolymers, ethylene-vinylacetate copolymers and polyesters. The preferred binder material is poly(vinyl butyral) which can be obtained commercially as BUTVAR B-76 from Monsanto Company.

The antihalation composition of this invention, or other materials of the elements, can also include other optional addenda commonly employed in such layers including, but not limited to, sensitizing dyes, stabilizers (or stabilizer precursors), development activators, brighteners, antifoggants, hardeners, plasticizers, lubricants, coating aids, melt formers, surfactants, and anti-fading agents. Melt formers or plasticizers, such as N-methyl-benzamide, dibutylphthalate N,N-diethyllauramide or tricresylphosphate are particularly useful in the antihalation composition in an amount of from about 0.5 to about 20 weight % (based on total binder weight).

The antihalation composition of this invention can be used as an antihalation component in a variety of photothermographic or thermographic elements. Useful elements include those designed to provide an image from photographic silver halide, such as color images, or elements designed for non-silver imaging. Photographic elements that are designed for microimaging are especially useful with the compositions of this invention.

The antihalation composition can be in any suitable location in such elements. It is necessary that the metallized or unmetallized formazan dye and the hexaarylbiimidazole compound be in "reactive association" with each other to provide the desired heat bleachability according to this invention. The term "in reactive association" is intended to mean that the described materials are in a location with respect to each other that enables the desired processing and heat bleaching. That is, the term is intended to mean that the hexaarylbiimidazole compound and the metallized or unmetallized formazan dye are in location with respect to one another which enables the desired change in dye color to colorless upon heating for the time specified herein. Thus, they can be in the same or different layers of the elements provided they are in reactive association.

The elements of this invention generally include a support (defined below) having thereon a photothermographic layer containing a photosensitive component which can be a silver photosensitive component or a non-silver photosensitive component. When a silver photosensitive component is used, silver halide is especially useful (such as silver chloride, silver iodide, silver bromide, silver bromoiodide, silver chlorobromide and silver chlorobromoiodide). A dispersion of silver behenate can also be used. Further details of such materials are known in the art, including the Levinson et al patents, noted above.

A variety of non-silver photosensitive components can also be used, if desired, comprising colored, heat bleachable compositions. These can be, for example, photosensitive diazo imaging materials, imaging materials based on photoreductants, photosensitive dyes and others readily apparent to one skilled in the art. These materials are also well known in the art, including the Levinson et al patents noted above.

It is useful in some elements to have an overcoat layer on the element of this invention. The overcoat can be over the photothermographic layer or antihalation layer, or both. The overcoat layer can be composed of one or more of the binder materials described above, or others readily apparent to one skilled in the art.

The elements of this invention can comprise a variety of supports that can tolerate the processing conditions. Typical supports include, but are not limited to, cellulose ester films (such as cellulose triacetate), poly(vinyl acetate), polyesters (such as polyethylene terephthalate or polyethylene naphthalate), polycarbonates, cellulose nitrate, glass, metals, and others readily apparent to one skilled in the art. A flexible and transparent film support is preferred. The supports can be subbed or unsubbed.

The antihalation composition of this invention can be part of the support, that is it can be present in a transparent support material. Alternatively, the antihalation composition is coated onto a support material using any of the conventional coating techniques and equipment.

A variety of imagewise exposure means are useful for exposure of an element of this invention. Typically, the element is exposed to a visible light or infrared radiation source to provide a developable image, but other sources of electromagnetic radiation are also useful. Heat processing of the element can be accomplished with any suitable heating means including a hot plate, infrared heater, heated roller or block. Processing is generally under ambient conditions of pressure and humidity.

The element of this invention can be used to provide a negative or positive image, depending for example, on the selection of the photosensitive component.

As used herein, the term "about" is used to define various parameters. In defining pKa, it refers to ±0.5 of the indicated value. In defining molar ratios and amounts, and other parameters, it refers to ±20% of the indicated value. In defining temperatures, it refers to ±5° C. of the indicated temperature.

The following examples are presented to illustrate the practice of this invention, but are not meant to limit it in any way. All percentages are by weight unless otherwise indicated.

Example 1: Preparation of Antihalation Composition

A composition of this invention was prepared containing the hexaarylbiimidazole R-1 (identified above) and zinc metallized complexes of the formazan dye F-3 (identified above). Several "control" compositions, outside the scope of this invention, were also prepared containing the hexaarylbiimidazoles shown below. Each composition was prepared with formazan dye (10 mg, 0.013 mmol), zinc acetate, hydrate (2.5 mg), hexaarylbiimidazole (0.026 mmol), o-anisic acid (17.6 mg) and poly(vinyl butyral) binder (10 g, 6% in acetone).

The compositions were coated as layer on poly(ethylene terephthate) support to form elements, and strips of the elements were heat processed under the conditions shown in Table I to evaluate their bleachability. The densities ($D_{max}$) were measured as transmittance densities at the $\lambda_{max}$ absorption wavelength for coating using an uncoated support as the reference sample.

TABLE III

| Composition | Hexaarylbiimidazole | Unprocessed | $D_{max}$ at $l_{max}$ (% bleaching) 5 sec/120° C. | 5 sec/140° C. |
|---|---|---|---|---|
| Control A | R-2 | 0.24 | 0.22(8) | 0.11(54) |
| Example 1 | R-1 | 0.21 | 0.03(86) | 0.02(90) |
| Control B | R-3 | 0.26 | 0.18(31) | 0.03(88) |
| Control C | R-4 | 0.24 | 0.24(0) | 0.14(42) |
| Control D | R-5 | 0.26 | 0.25(4) | 0.26(0) |

It is apparent from the data in Table I that the composition of this invention provided rapid and effective bleaching at a lower processing temperature than did the compositions outside the scope of the invention. The hexaarylbiimidazole used in Control A is the same one used in Example 55 of U.S. Pat. No. 4,201,590 (noted above). The compound used in Control B is also within the scope of the teaching of this patent, that is, when R is methyl and R' is hydrogen (structure of Column 4). These materials provided moderate bleaching (more than 70%) only at the higher bleaching temperature.

Hexaarylbiimidazoles:

("Ph" refers to phenyl)

R-2

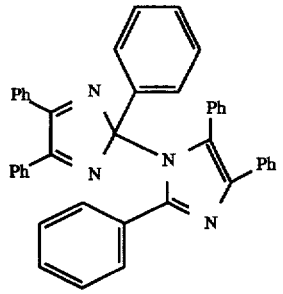

R-3

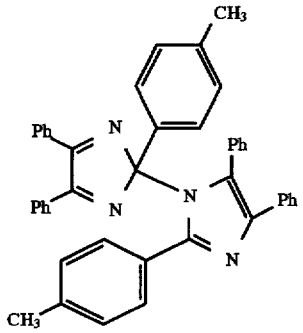

R-4

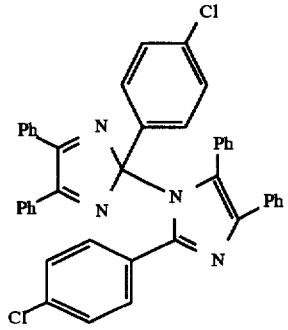

-continued

R-5

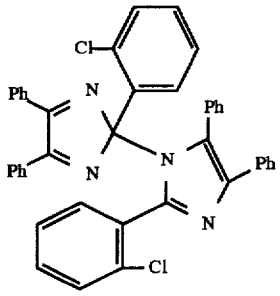

Examples 2–3: Comparative Examples

Two compositions of this invention were compared directly to the antihalation composition illustrated in Example 55 of U.S. Pat. No. 4,201,590 (noted above). The compositions of this invention were prepared using formazan dye F-6 (40 mg), zinc acetate, hydrate (0.5 or 1 equivalent), hexaarylbiimidazole R-1 (2 equivalents), o-anisic acid (5 equivalents), and poly(vinyl butyral) binder (10 g, 6% in dichloromethane).

The Control E composition of the prior art contained the same metallized formazan dye (2 equivalents of zinc ion), the hexaarylbiimidazole R-2 (5 equivalents), and 1-naphthoic acid (2 equivalents). The Control F composition contained the same metallized formazan dye (0.5 equivalents of zinc ion), the hexaarylbiimidazole R-2 (5 equivalents) and o-anisic acid (5 equivalents).

The results of heat processing are shown in Table II below. It is evident that the compositions of the present invention were bleached more effectively at the lowest bleaching temperature compared to the prior art compositions. Thus, the use of the alkoxy-substituted hexaarylbiimidazole R-1 according to this invention provides significantly better bleaching efficiency under less rigorous bleaching conditions (lower temperature and shorter times).

TABLE II

| Composition | Zinc Equivalents | Hexaarylbiimidazole | HABI Equivalents | Acid Equivalents | $D_{max}$ at $\lambda_{max}$ (% bleaching) Unprocessed | 5 sec/120° C. | 5 sec/140° C. | 5 sec/60° C. |
|---|---|---|---|---|---|---|---|---|
| Control E | 2 | R-2 | 5 | 2 | 1.33 | 1.01(24) | 0.34(74) | 0.14(89) |
| Example 2 | 1 | R-1 | 2 | 5 | 0.84 | 0.13(85) | 0.01(99) | 0.01(99) |
| Example 3 | 0.5 | R-1 | 2 | 5 | 0.26 | 0.08(69) | 0.01(96) | — |
| Control F | 0.5 | R-2 | 2 | 5 | 0.28 | 0.23(18) | 0.17(39) | — |

Example 4: Effect of Acid in Bleachable Composition

A composition was prepared with the oxidative dimer of R-1 (17.1 mg, 0.026 mol) and zinc complexed formazan dye F-11 (10 mg, 0.013 mol) dissolved in poly(vinyl butyral) binder (10 g, 6% in acetone). The amounts of naphthoic acid included in the composition are shown in Table III below. Each composition was coated onto polyethylene terephthalate support at a wet thickness of about 0.01 cm and dried at 135°–150° C. for 2–3 minutes. Strips of the resulting element were processed on heating blocks under the noted conditions.

From the data in Table III, it is apparent that the presence of naphthoic acid decreased the processing temperature needed to achieve substantial bleaching (over 90%), and increased bleaching at the lowest processing temperature.

TABLE III

| Composition | Equivalents of Acid | $D_{max}$ at $\lambda_{max}$ (% bleaching) Unprocessed | 15 sec/120° C. | 15 sec/140° C. | 10 sec/160° C. |
|---|---|---|---|---|---|
| Control F | 0 | 0.50 | 0.47(6) | 0.40(20) | 0.27(46) |
| Invention | 1 | 0.47 | 0.35(25) | 0.19(60) | 0.14(70) |
| Invention | 5 | 0.49 | 0.15(69) | 0.05(90) | 0.05(90) |
| Invention | 20 | 0.34 | 0.14(59) | 0.12(65) | — |

Example 5: Effect of Hexaarylbiimidazole Level in Composition

Compositions of this invention were prepared using a zinc complex of formazan dye F-11 (10 mg, 0.013 mol), hexaarylbiimidazole R-1 (various amounts), naphthoic acid (various amounts) in poly(vinyl butyral) binder (10 g, 6% in acetone). The compositions were coated and evaluated as described in previous examples. The results are shown in Table IV below. It is apparent that with greater levels of hexaarylbiimidazole, bleaching is more effective. With higher acid levels, less hexaarylbiimidazole is needed.

TABLE IV

| Equivalents Hexaarylbiimidazole | Equivalents of Acid | $D_{max}$ at $\lambda_{max}$ (% bleaching) Unprocessed | 15 sec/120° C. | 15 sec/140° C. | 10 sec/160° C. |
|---|---|---|---|---|---|
| 1 | 1 | 0.45 | 0.35(22) | 0.26(41) | 0.21(53) |
| 2 | 1 | 0.45 | 0.38(16) | 0.20(56) | 0.07(84) |
| 4 | 1 | 0.43 | 0.29(33) | 0.18(58) | 0.01(98) |
| 2 | 5 | 0.49 | 0.15(69) | 0.05(90) | — |

Examples 6–9: Effect of Metals on Bleaching

Several compositions of this invention were prepared with hexaarylbiimidazole R-1 (2 equivalents), zinc or copper metallized formazan complexes (10 mg dye), 1-naphthoic acid (5 equivalents), N-methylbenzamide melt former (0 or 100 mg) in poly(vinyl butryal) binder (10 g, 6% in acetone). The Controls were similarly prepared without 1-naphthoic acid, or with 1-naphthoic acid using nickel metallized dye F-17 having the following structure:

F-17

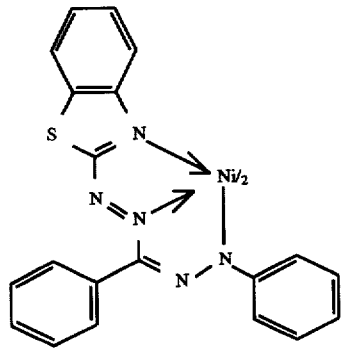

The results of heat processing are shown in Table V below. It is apparent that the zinc metallized dye was readily bleached in the presence of naphthoic acid, but the nickel metallized dye was not. The copper metallized dye was bleached in the presence or absence of acid, but the melt former also enhanced bleaching.

TABLE V

| Composition | Dye | Equivalents of Acid | Melt former | $D_{max}$ at $\lambda_{max}$ (% bleaching) Un-processed | 15 sec/120° C. | 15 sec/140° C. | 5 sec/160° C. |
|---|---|---|---|---|---|---|---|
| Control G | F-13 | 0 | 0 | 0.35 | 0.35(0) | 0.33(6) | — |
| Control H | F-17 | 0 | 0 | 0.34 | 0.34(0) | 0.34(0) | — |
| Control I | F-12 | 0 | 0 | 0.22 | 0.22(0) | 0.18(18) | — |
| Example 6 | F-13 | 5 | 0 | 0.31 | 0.12(61) | 0.05(84) | — |
| Control J | F-17 | 5 | 0 | 0.34 | 0.34(0) | 0.34(0) | — |
| Example 7 | F-12 | 5 | 0 | 0.21 | 0.24(33) | 0.06(71) | — |
| Example 8 | F-13 | 5 | 100 mg | 0.29 | 0.10(66) | 0.05(83) | — |
| Control K | F-17 | 5 | 100 mg | 0.33 | 0.33(0) | 0.33(0) | — |
| Example 9 | F-12 | 5 | 100 mg | 0.21 | 0.07(67) | 0.02(90)* | — |
| Example 10 | F-11 | 5 | 100 mg | 0.40 | 0.11(73) | 0.06(85)* | 0.04(90) |
| Control L | F-17 | 5 | 100 mg | 0.43 | 0.43(0) | 0.43(0) | 0.43(0) |

*5 sec at 140° C.

Example 11: Effect of Acids on Bleaching

Compositions were prepared with zinc metallized formazan dye F-11 (10 mg), hexaarylbiimidazole R-1 (2 equivalents), various acids (5 equivalents) in poly(vinyl butyral) binder (10 g, 6% in acetone). The acid pKa values were obtained or calculated using several known publications [Perrin, *Dissociation Constants of Organic Bases in Aqueous Solutions,* Butterworths, London, 1965, Perrin et al, *pKa Predictions for Organic Acids and Bases,* Chapman & Hall, New York, 1981, Weast (Ed.), *CRC Handbook of Chemistry and Physics,* 55th. Ed., CRC Press, 1974, D-127, and Hall, *J. Amer. Chem. Soc.,* 79, 5441, 1957].

The various compositions were processed as described in previous examples. The bleaching results are shown in Table VI below. The acids providing more effective bleaching have a pKa in the range of from about 3 to about 6. Optimum bleaching was obtained using most acids having a pKa in the range of from about 4.5 to about 5.5.

TABLE VI

| Acid | mp (°C.) | pKa | $D_{max}$ at $\lambda_{max}$ (% bleached) Unprocessed | 5sec/ 120° C. | 15sec/ 120° C. | 15sec/ 140° C. | 15sec/ 160° C. |
|---|---|---|---|---|---|---|---|
| picolinic | 140 | 5.5 | 0.27 | 0.24(11) | — | 0.21(29) | 0.10(63) |
| 4-propoxybenzoic | 144 | 4.8 | 0.40 | 0.16(60) | 0.05(88) | 0.02(95) | — |
| palmitic | 62 | 4.8 | 0.36 | 0.22(39) | 0.09(75) | 0.01(97) | — |
| p-toluic | 274 | 4.4 | 0.45 | 0.25(44) | 0.11(76) | 0.05(89) | 0.03(93) |
| 4-(n-propyl)-benzoic | 143 | 4.4 | 0.38 | 0.19(50) | 0.07(82) | 0.02(95) | — |
| 4-(n-pentyl)-benzoic | 88 | 4.4 | 0.38 | 0.15(61) | 0.05(87) | 0.02(95) | — |
| 4-ethylamido-benzoic | 237 | 4.3 | 0.41 | 0.23(42) | 0.12(71) | 0.02(95) | — |
| 2,4-dimethyl-benzoic | 125 | 4.2 | 0.46 | 0.29(37) | 0.14(70) | 0.07(85) | 0.03(93) |
| benzoic | 122 | 4.2 | 0.41 | — | 0.15(63) | 3.09(78)* | — |
| 4-chlorobenzoic | 240 | 4.0 | 0.42 | 0.27(36) | 0.09(79) | 0.05(88) | 0.03(93) |
| o-toluic | 104 | 3.9 | 0.43 | 0.22(49) | 0.10(77) | 0.05(88) | 0.03(93) |
| 1-naphthoic | 161 | 3.7 | 0.49 | — | 0.15(69) | 0.07(86) | 0.04(92) |
| 2-phenoxy-2—methylpropanoic | 99 | 3.2 | 0.33 | 0.18(45) | 0.06(82) | 0.02(94) | — |
| 2-hydroxy-5-[2—(2,4,4-trimethyl)—pentane]benzoic | 159 | 3.1 | 0.26 | 0.09(65) | 0.04(85) | 0.02(92) | — |
| 5-methylsalicylic | 152 | 3.0 | 0.30 | 0.16(47) | 0.10(67) | 0.07(77) | 0.05(83) |
| 2-chlorobenzoic | 139 | 2.9 | 0.38 | 0.22(42) | 0.10(74) | 0.07(82) | 0.05(87) |
| 2,6-dichloro-benzoic | 144 | 2.6 | 0.29 | 0.21(28) | 0.15(48) | 0.10(66) | 0.08(72) |
| p-toluenesulfonic | 104 | 2.3 | | | bleached** | | |
| 2,5-dimethoxy-phenylsulfonic | 104 | NA | | | bleached** | | |
| 1-naphthalene-sulfonic | 78 | 0.2 | 0.45 | 0.42(7) | 0.38(16) | 0.20(56) | 0.10(78) |

*5 sec/140° C.
**Bleached spontaneously during preparation of composition
NA = not available Example 12: Effect of Coating Solvents on Bleaching Several compositions of the invention were prepared using various binder materials (10 g, shown in Table VII) in either acetone or tetrahydrofuran (THF) (6%), zinc metallized formazan dye F-11 (10 mg), hexaarylbiimidazole R-1 (2 equivalents), 4-propoxybenzoic acid (5 equivalents). The bleaching results shown in Table VII indicates that for a given binder material, there may be an optimum coating solvent. Routine experimentation may be used by a skilled artisan to determine the optimum combination of materials.

TABLE VII

| Composition | Polymeric Binder | Solvent | $D_{max}$ at $\lambda_{max}$ (% bleaching) Unprocessed | 5 sec/120° C. | 5 sec/140° C. | 5 sec/160° C. |
|---|---|---|---|---|---|---|
| 94 | SARAN F-310 | acetone | 0.45 | 0.30(33) | 0.20(56) | 0.18(60) |
| 95 | SARAN F-310 | THF | 0.47 | 044(6) | 0.37(21) | 0.33(30) |
| 96 | CAB 381-20 | acetone | 0.45 | 0.29(36) | 0.05(89) | 0.03(93) |
| 97 | CAB 381-20 | THF | 0.51 | 0.48(6) | 0.27(25) | 0.15(71) |
| 98 | BUTVAR B-76 | acetone | 0.56 | 0.36(36) | 0.06(89) | 0.03(95) |
| 99 | BUTVAR B-76 | THF | 0.59 | 0.52(12) | 0.19(68) | 0.11(81) |

SARAN F-310 is a copolymer of acrylonitrile and vinylidene chloride (available from Dow Chemical Co.), CAB 381-20 is cellulose acetate butyrate (available from Eastman Chemical Co.), and BUTVAR B-76 is poly(vinyl butyral) (available from Monsanto Co.).

Example 13: Preparation of Compositions In Situ

An alternative and preferred method for preparing the compositions of this invention is to mix metal ion, formazan dye and hexaarylbiimidazole together so that the metallized dye complex is formed within the reaction mixture and used therein without isolation. This procedure is described in more detail in our copending and commonly assigned U.S. Ser. No. 08/698,611, filed on Aug. 16, 1996, and based on Provisional Application 60/006,981 filed on even date herewith by Perry, Goswami and Zielinski and entitled "Method of Preparing Heat Bleachable Antihalation Compositions and Compositions Prepared Therefrom". This method is contrasted with a formulation in which the metallized formazan dye complex is preformed and then mixed with the hexaarylbiimidazole.

Table VIII below shows the results of bleaching of compositions formulated from zinc acetate (various amounts), formazan dye F-1 or F-3 (10 mg), hexaarylbiimidazole (2 equivalents), 4-propoxybenzoic acid (various amounts) in poly(vinyl butyral) binder (10 g) in acetone (6%).

TABLE VIII

| Dye | Equivalents of $Zn(OAc)_2$ | $\lambda_{max}$ (nm) | Acid | $D_{max}$ at $\lambda_{max}$ (% bleaching) Unprocessed | 5 sec/120 ° C. | 5 sec/140° C. | 5 sec/160° C. |
|---|---|---|---|---|---|---|---|
| F-3 | 0.5 | 676 | — | 0.34 | 0.33(3) | 0.28(18) | 0.21(38) |
| F-3 | 1.0 | 675 | — | 0.39 | 0.26(33) | 0.16(59) | 0.11(72) |
| F-3 | 2.0 | 674 | — | 0.36 | 0.24(33) | 0.11(69) | 0.05(86) |
| F-3 | 0.5 | 675 | 5 equiv | 0.25 | 0.08(68) | 0.01(96) | — |
| F-3 | 1.0 | 677 | 5 equiv | 0.33 | 0.09(73) | 0.01(97) | — |
| F-3 | 2.0 | 676 | 5 equiv | 0.34 | 0.09(74) | 0.01(97) | — |
| F-1 | 0.5 | 665 | — | 0.36 | 0.31(14) | 0.25(31) | 0.19(47) |
| F-1 | 1.0 | 659 | — | 0.41 | 0.26(37) | 0.14(66) | 0.09(78) |
| F-1 | 2.0 | 659 | — | 0.41 | 0.23(44) | 0.10(76) | 0.03(93) |
| F-1 | 0.5 | 655 | 5 equiv | 0.27 | 0.07(74) | 0.01(96) | — |
| F-1 | 1.0 | 664 | 5 equiv | 0.31 | 0.07(77) | 0.01(97) | — |
| F-1 | 2.0 | 663 | 5 equiv | 0.32 | 0.08(75) | 0.01(97) | — |

Example 14: Preferred Compositions

Preferred compositions were prepared with formazan dye F-3 (10 mg), hexxarylbiimidazole R-1 (2 equivalents), and various isomers of anisic acid in poly(vinyl butyral) binder (10 g) in acetone (6%).

The results are shown in Table IX below.

TABLE IX

| Equivalents of $Zn(OAc)_2$ | Acid | $D_{max}$ at $\lambda_{max}$ (% bleaching) Unprocessed | 5 sec/120° C. | 15 sec/120° C. | 5 sec/140° C. |
|---|---|---|---|---|---|
| 1.0 | o-anisic acid | 0.34 | 0.05(85) | 0.03(91) | — |
| 1.0 | m-anisic acid | 0.28 | 0.05(82) | 0.03(89) | — |
| 1.0 | p-anisic acid | 0.31 | 0.08(74) | 0.03(90) | — |

Example 15: Photothermographic Element

A photothermographic element was prepared as follows:

An antihalation composition of this invention was prepared by simultaneously mixing formazan dye F-3 (1.2 g), hexaarylbiimidazole R-1 (3.66 g), zinc acetate, hydrate (0.11 g), o-anisic acid (0.81 g), and poly(vinyl butyral) (300 g 8%) in a solvent mixture (80:20 by weight) of methyl isobutylketone and acetone using procedures described above. This composition was then coated on a conventional poly (ethylene terephthalate) film support.

On the opposite side of the support, a photosensitive layer and an overcoat layer were coated.

The photosensitive layer was formulated from a silver behenate dispersion (37.53 g Ag/l, 6.2% BUTVAR B-76 polymer binder in methyl isobutylketone), silver bromide emulsion (40.91 g Ag/l, 13.2% BUTVAR B-76 polymer binder in methyl isobutylketone), succinimide (10%, 10.5% BUTVAR B-76 polymer binder in acetone), dimethylsiloxane surfactant (10% in methyl isobutylketone), monobromo (* shown below, 2.5%, 10.5% BUTVAR B-76 polymer binder in acetone), triazine (* shown below, 2.5%, 10.5% BUTVARB-76 in methyl isobutylketone), dye (* shown below, 0.2% in methanol), sulfonamidophenol (10%, 10.5% BUTVARB-76 polymer binder in methyl isobutylketone), palmitic acid (10%, 10.5% BUTVAR B-76 polymer binder in acetone), and BUTVAR B-76 poly(vinyl butyral) polymer binder (10.5%) in methyl isobutylketone. The photosensitive compostion was coated on the support and dried using conventional techniques.

*monobromo

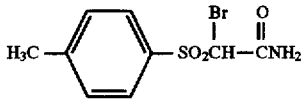

*triazine

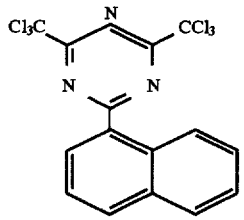

*dye

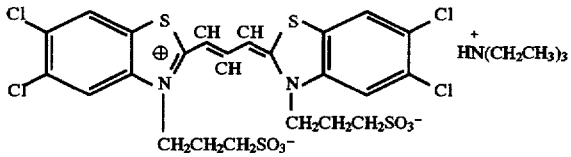

The overcoat layer was formulated from poly(vinyl alcohol) (6.4% in water), Olin 10 G surfactant (10% in water), p-toluenesulfonic acid (1 normal in water), methanol and tetraethylorthosilicate, and water. It was similarly coated and dried.

The resulting element was imagewise exposed using a commercial EG & G sensitometer for $10^{-3}$ seconds, and then heat processed at 119° C. for 5 seconds to provide sharp step-tablet images in the element. Little residual color from the formazan dye in the antihalation layer was observed.

A sample of this element was imagewise exposed using a commercial EG & G sensitometer for $10^{-3}$ second then heat processed for 5 seconds at 119° C. The resulting step-tablet images in the element were very sharp, indicative that the antihalation layer was "bleached" (turned colorless) by the heat processing.

A Control element was similarly prepared except that no antihalation layer was coated on the film support opposite the photosensitive layer. After processing, the resulting images were blurry, indicative of poor halation protection.

Examples 16–26: Antihalation Compositions Containing Various Hexaarylbiimidazoles Various antihalation compositions were prepared by in situ mixing of formazan dye F-3 (0.0231 mmol), zinc acetate, hydrate (0.0115 mmol), o-anisic acid (0.1155 mmol) and various hexaarylbiimidazoles (see Table X below, 0.0462 mmol), poly(vinyl butyral) (6%, 10 g) in acetone. Each composition was coated on a poly(ethylene terephthalate) support and heat processed. The various hexaarylbiimidazoles, in reference to R and R' groups (for structure Ia) and —X— Z—X'— groups (for structure Ib), and bleaching results are shown in Table X below.

TABLE X

| | | | | $D_{max}$ at $\lambda_{max}$ (% bleaching) | | | | |
|---|---|---|---|---|---|---|---|---|
| Composition | R | R' | R¹# | Un-processed | 5 sec/ 120° C. | 5 sec/ 120° C. | 5 sec/ 140° C. | 5 sec/ 160° C. |
| Example 16* | methoxy | methoxy | H | 0.23 | 0.05(78) | 0.07(70) | 0.03(87) | — |
| Example 17 | methoxy | methoxy | H | 0.22 | 0.15(32) | — | 0.08(64) | 0.01(95) |
| Example 18 | ** | ** | H | 0.18 | 0.03(83) | 0.01(94)) | 0.01(94)) | — |
| Example 19 | methoxy | H | H | 0.21 | 0.03(86) | 0.02(90)) | — | — |
| Example 20 | n-butoxy | H | H | 0.19 | 0.02(89) | 0.01(95) | 0.01(95) | — |
| Example 21 | H | methoxy | H | 0.19 | 0.12(37) | 0.01(95) | 0.01(95) | — |
| Example 22 | H | benzoxy | H | 0.22 | 0.18(18) | 0.11(50) | — | 0.01(95) |
| Example 23 | n-butoxy | H | methoxy | 0.12 | 0.02(83) | — | — | — |
| Example 24 | methoxy | H | methyl | 0.04 | 0.01(75) | — | — | — |
| Example 25 | methoxy | H | H | 0.10 | 0.02(80) | — | — | — |
| Example 26 | n-butoxy | H | methyl | 0.19 | 0.14(26) | 0.03(84) | — | — |
| Control M*** | H | H | H | 0.28 | 0.26(7) | — | 0.25(11) | 3.22(21) |
| Control N | methyl | H | H | 0.26 | 0.18(31) | 0.03(88) | 0.01(96) | — |
| Control O | t-butyl | H | H | 0.25 | 0.17(32) | 0.02(92) | 0.01(96) | — |
| Control P | H | H | H | 0.24 | 0.22(8) | — | 0.11(54) | 0.01(96) |
| Control Q | chloro | H | H | 0.24 | 0.24(0) | — | 0.14(42) | 0.02(92) |
| Control R | H | chloro | H | 0.22 | 0.21(5) | — | 0.14(36) | 0.06(73) |
| Control S≠ | H | H | H | 0.26 | 0.25(4) | — | 0.26(0) | 0.25(4) |
| Control T | nitro | H | H | 0.27 | 0.22(19) | — | 0.59(0) | 0.68(0) |
| Control U | methoxy | H | methoxy | 0.17 | 0.17(0) | — | — | — |

*Also contained methoxy in 5-position of phenyl ring carrying R and R'.
**Compound of structure Ib wherein X and X' were both oxy, and Z was methylene.
***Compound of Structure Ia wherein phenyl ring carrying R and R' had a methoxy in the 2-position.
≠Compound of Structure Ia wherein phenyl ring carrying R and R' had a chloro in the 2-position.
#Substituents at para position of phenyl ring.

Examples 27–29: Bleaching Antihalation Compositions Comprising Unmetallized Formazan Dyes Antihalation compositions were prepared containing formazan due (10 mg), hexaarylbiimidzaole R-1 or R-2 (identified in Example 1, 2 equivalents) and 1 or R-2 (identified in Example 1, 2 equivalents) and poly(vinyl butyral) binder (10 g. 6%) in acetone. The compositions containing compound R-1 are within this invention and those containing compound R-2 are not (controls).

Each composition was coated on a poly(ethylene terephthalate) and heat processed as described herein. The bleaching results are described in Table XI below. The results show that the compositions of this invention are bleached more rapidly at lower temperatures than those outside the present invention.

TABLE XI

| | | | $D_{max}$ at $\lambda_{max}$ (% bleaching) | | | | |
|---|---|---|---|---|---|---|---|
| Composition | Formazan Dye | Hexaaryl-biimidazole | Un-processed | 5 sec/ 120° C. | 15 sec/ 120° C. | 5 sec/ 140° C. | 5 sec/ 160° C. |
| Control V | F-1 | R-2 | 0.22 | 0.18(18) | 0.15(32) | 0.06(73) | 0.03(86) |
| Example 27 | F-1 | R-1 | 0.18 | 0.03(83) | 0.03(83) | — | |
| Control W | F-2 | R-2 | 0.30 | 0.27(10) | 0.23(23) | 0.13(57) | 0.02(93) |
| Example 28 | F-2 | R-1 | 0.24 | 0.03(88) | 0.03(88) | — | |
| Control X | F-3 | R-2 | 0.30 | 0.23(23) | 0.18(40) | 0.06(80) | 0.02(93) |
| Example 29 | F-3 | R-1 | 0.21 | 0.03(86) | 0.03(86) | — | — |

The invention has been described in detail with particular reference to preferred embodiments thereof, but it will be understood that variations and modifications can be effected within the spirit and scope of the invention.

We claim:

1. A colored, heat bleachable antihalation composition comprising:

(a) a formazan dye that absorbs at from 400 to 850 nm, and (b) at least one hexaarylbiimidazole that consists essentially of an oxidative arylimidazole dimer of a compound represented by either structure Ia or Ib:

Ia

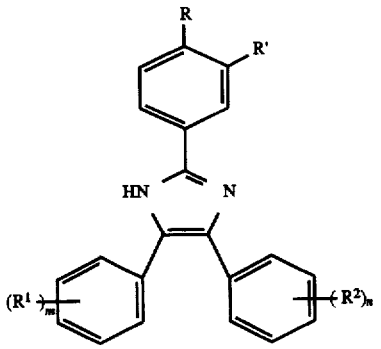

-continued

Ib

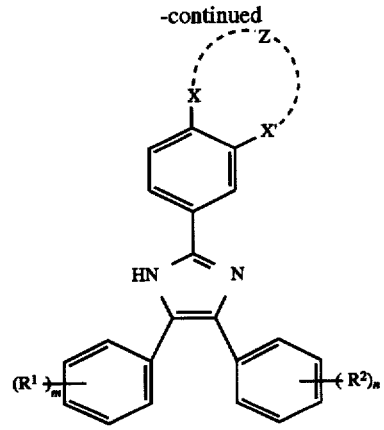

wherein R and R' are independently hydrogen, an alkyl group of 1 to 12 carbon atoms, an alkoxy group of 1 to 8 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is said alkoxy group, X and X' are independently oxy or imino, Z is alkylene of 1 or 2 carbon atoms, and $R^1$ and $R^2$ are independently defined the same as R and R' except that neither $R^1$ nor $R^2$ is hydrogen, said antihalation composition being bleachable when subjected to a temperature of from about 80° to about 150° C. for from about 1 to about 60 seconds.

2. The composition of claim 1 wherein the molar ratio of said hexaarylbiimidazole to said metallized formazan dye is from 1:1 to 5:1.

3. The composition of claim 1 wherein said formazan dye is present in a metallized formazan dye complex comprising said dye and a metal that has a log (K) with said dye of ≦25, and said composition further comprises a carboxylic acid present at a molar ratio to the metal in said metallized formazan dye complex of from 1:1 to 20:1.

4. The composition of claim 1 wherein said formazan dye has the structure II:

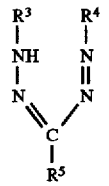

wherein $R^3$ is an aromatic group of 6 to 20 atoms in the ring, $R^4$ is an aryl group having 6 to 14 carbon atoms in the ring system, and $R^5$ is an alkyl group of 1 to 20 carbon atoms, an aryl group of 6 to 14 carbon atoms in the ring system, or a heterocyclic ring having 5 to 7 atoms in the ring.

5. The composition of claim 4 wherein $R^3$ is a coordinating aromatic group having 5 to 15 atoms in the ring system, and said formazan dye is complexed with a cobalt, zinc, cadmium or copper.

6. The composition of claim 1 wherein at least one of R and R' is alkoxy of 1 to 8 carbon atoms.

7. The composition of claim 6 wherein R is alkoxy of 1 to 6 carbon atoms.

8. The composition of claim 1 wherein $R^1$ and $R_2$ are independently a substituted or unsubstituted alkyl group of 1 to 4 carbon atoms or an alkoxy group of 1 to 4 carbon atoms, m and n are each 0 or 1, at least one of X and X' is oxy, and Z is methylene.

9. The composition of claim 3 wherein said carboxylic acid is p-propoxybenzoic acid, o-, p- or m-anisic acid, palmitic acid, 2-chlorobenzoic acid, 1-naphthoic acid or 4-propylbenzoic acid.

10. The composition of claim 1 further comprising a film-forming, organic solvent soluble binder material.

11. The composition of claim 10 wherein said binder material is a polystyrene, polyacrylate or polymethacrylate, a polycarbonate, cellulose ester, polysulfonamide, polyvinyl or polyvinylidene halide, polyvinyl acetate, maleic anhydride ester copolymer, an acrylonitrile-vinylidene chloride copolymer, polyvinyl acetal, an ethylene-vinyl acetate copolymer, butadiene-styrene copolymer, or a polyester.

12. The composition of claim 1 that is bleachable when subjected to a temperature of from 100° to 150° C. for a time of up to 30 seconds.

13. The composition of claim 5 wherein said complex metal is zinc, R is alkoxy of 1 to 4 carbon atoms, R' is hydrogen, m and n are each 0, $R^3$ is p-nitrophenyl, $R^4$ is benzthiazole, and $R^5$ is p-methoxyphenyl, and said composition further comprises poly(vinyl butyral) as a binder material, and an organic carboxylic which is o-anisic acid.

14. A photothermographic element comprising a support having thereon a photothermographic layer, and further comprising, on or in said support, an antihalation composition comprising:

(a) a formazan dye that absorbs at from about 400 to about 850 nm, and (b) at least one hexaarylbiimidazole that consists essentially of an oxidative arylimidazole dimer of a compound represented by either structure Ia or Ib:

Ia

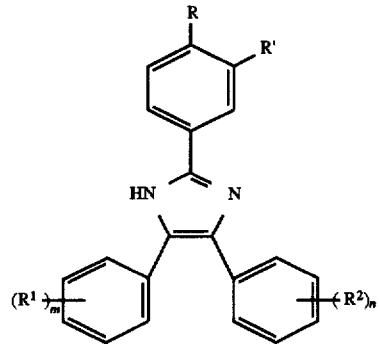

Ib

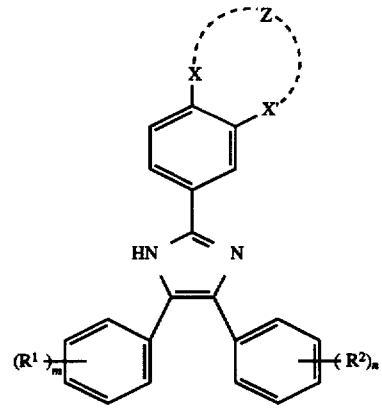

wherein R and R' are independently hydrogen, an alkyl group of 1 to 12 carbon atoms, an alkoxy group of 1 to 8 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is said alkoxy group, X and X' are independently oxy or imino, Z is alkylene of 1 or 2 carbon atoms, and $R^1$ and $R^2$ are independently defined the same as R and R' except that neither $R^1$ nor $R^2$ is hydrogen, said antihalation composition being bleachable when subjected to a temperature of from 80° to 150° C. for from 1 to 60 seconds.

15. The element of claim 14 wherein said antihalation composition is in said support.

16. The element of claim 14 wherein said antihalation composition is formed as a layer on said support, opposite said photothermographic layer.

17. The element of claim 14 wherein said antihalation composition is formed as a layer on said support, on the same side as said photothermographic layer.

18. The element of claim 14 wherein said photothermographic layer is a silver halide or silver behenate imaging layer.

19. The element of claim 14 wherein said formazan dye is present in a metallized formazan dye complex comprising a metal that has a log (K) with said dye of ≦25.

20. The element of claim 19 wherein said metal is zinc.

21. The element of claim 19 wherein said antihalation composition further comprises at least one carboxylic acid having a pKa of from 3 to 6.

22. A method for providing an image comprising subjecting an imagewise exposed photothermographic element to heat at from about 80° to 150° C. for from 1 to about 60 seconds, said element comprising a support having thereon a photothermographic layer, and further comprising on or in said support, an antihalation composition comprising:

(a) a metallized formazan dye complex that absorbs at from 500 to 850 nm, said complex comprising a formazan dye and a metal that has a log (K) with said dye of less than or equal to about 25, (b) at least one hexaarylbiimidazole that consists essentially of an oxidative arylimidazole dimer of a compound represented by either structure Ia or Ib:

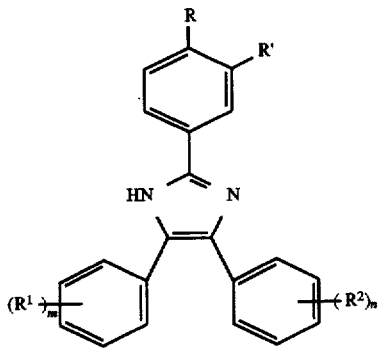

Ia

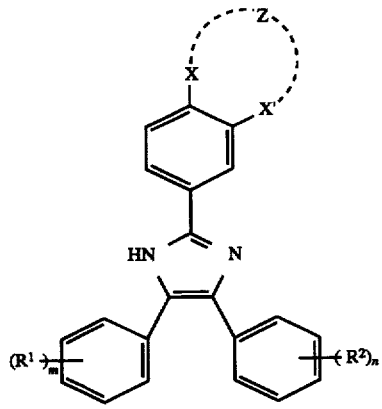

Ib wherein R and R' are independently hydrogen, an alkyl group of 1 to 12 carbon atoms, an alkoxy group of 1 to 8 carbon atoms, amino, a cycloalkyl group having 5 to 7 carbon atoms in the ring, or an electron-rich heterocyclic group having 5 to 7 atoms in the ring, and m and n are independently integers of 0 to 5, provided that at least one of R and R' is said alkoxy group, X and X' are independently oxy or imino, Z is alkylene of 1 or 2 carbon atoms, and $R^1$ and $R^2$ are independently defined the same as for R and R' except that neither $R^1$ and $R^2$ is hydrogen, and (c) at least one organic carboxylic acid having a pKa of from 3 to 6, said antihalation composition being bleachable when subjected to said heating conditions.

23. The method of claim 22 wherein said element is heated at from 100° to about 150° C. for up to 30 seconds.

24. The method of claim 22 wherein said element is heated at from 110° to 140° C. for from 1 to about 15 seconds.

* * * * *

UNITED STATES PATENT AND TRADEMARK OFFICE

CERTIFICATE OF CORRECTION

PATENT NO. : 5,705,323
DATED : Jan 6, 1998
INVENTOR(S) : Robert J. Perry, et al

It is certified that error appears in the above-identified patent and that said Letters Patent is hereby corrected as shown below:

| | |
|---|---|
| Title page, col. 1, after [22], insert | -- **Related U.S. Application Data** [60] Provisional Application Serial No. 60/008,156, filed October 31, 1995. -- |
| Col. 1, line 4 | --**CROSS REFERENCE TO RELATED APPLICATION** Reference is made to and priority claimed from U.S. Provisional Application Serial No. US 60/008,156, filed October 31, 1995, entitled HEAT BLEACHABLE ANTIHALATION COMPOSITION, ELEMENTS CONTAINING SAME AND METHOD OF USE. -- |

Signed and Sealed this

Thirty-first Day of March, 1998

Bruce Lehman

*Attest:*

BRUCE LEHMAN

*Attesting Officer*

*Commissioner of Patents and Trademarks*